US005547015A

United States Patent [19]

Johansen

[11] Patent Number: 5,547,015

[45] Date of Patent: Aug. 20, 1996

[54] METHOD AND APPARATUS FOR MANUFACTURING MOULDS OR MOULD PARTS BY BLOWING PARTICULATE MATERIAL INTO A MOULD CHAMBER

[75] Inventor: Jan B. Johansen, Humlebæk, Denmark

[73] Assignee: Dansk Industri Syndikat A/S, Herlev, Denmark

[21] Appl. No.: 266,548

[22] Filed: Jun. 28, 1994

[30] Foreign Application Priority Data

Jul. 1, 1993 [DK] Denmark ..... 0781/93

[51] Int. Cl.[6] ..... B22C 11/10; B22C 15/24; B22C 15/28

[52] U.S. Cl. ..... 164/456; 164/20; 164/38; 164/155.3; 164/195; 164/200

[58] Field of Search ..... 164/456, 20, 22, 164/151, 155.3, 154.8, 200, 37, 38, 195

[56] References Cited

U.S. PATENT DOCUMENTS 2,779,074 1/1957 Herbruggen ..... 164/20
2,798,266 7/1957 Herbruggen ..... 164/22
3,008,199 11/1961 Jeppesen ..... 164/22
4,791,974 12/1988 Larsen ..... 164/195 X
5,332,025 7/1994 Larsen ..... 164/456

FOREIGN PATENT DOCUMENTS 0164731 12/1985 European Pat. Off. ..... 164/19

*Primary Examiner*—J. Reed Batten, Jr.
*Attorney, Agent, or Firm*—Larson & Taylor

[57] ABSTRACT

The blowing-in of the sand into the mould is continued while the pressure in the mould chamber increases through a maximum mould pressure and the blowing-in is terminated at a predetermined time period subsequent to reaching maximum pressure. This method ensures that the mould chamber will be completely filled independently of its size or shape without having to keep the blowing-in mould sand active for a longer time than absolutely necessary.

9 Claims, 4 Drawing Sheets

METHOD AND APPARATUS FOR MANUFACTURING MOULDS OR MOULD PARTS BY BLOWING PARTICULATE MATERIAL INTO A MOULD CHAMBER

TECHNICAL FIELD

The present invention relates to a blow moulding apparatus for blowing mould sand into a mould chamber and providing means for completely filling the mould chamber by continuing the blowing-in after the maximum mould pressure has passed through the mould chamber.

BACKGROUND ART

A method for blowing sand into sand mounds is disclosed in U.S. Pat. No. 2,779,074. According to this publication, the blowing-in operation, that is carried out intermittently or stepwise, is terminated when the pressure in the mould chamber has risen up to a certain value. Apparently, this is primarily a safety measure, but the possibility cannot, of course, be ruled out that the selected pressure corresponds to a certain degree of filling of the mould chamber.

SUMMARY OF THE INVENTION

Experiments performed by the inventors have shown that the air pressure in the mould chamber takes on a maximum value at the instant the mould chamber has been filled with mould sand or other mould material, irrespective of whether the mould chamber is large or small or is shaped in one way or the other.

For this reason, it is the object of the invention, based upon the observation referred to above, to provide a method, with which it is possible to achieve a complete filling of the mould chamber without the need to keep the blowing in operation in the active state longer than absolutely necessary.

The invention also relates to an apparatus for carrying out the method according to the invention.

Advantageous embodiments of the method and the apparatus, the effects of which—beyond what is self-evident—will appear from the following detailed portion of the present specification, are set forth below.

BRIEF DESCRIPTION OF THE DRAWINGS

In the following, the invention will be explained in more detail with reference to the drawing, in which.

DESCRIPTION OF THE PREFERRED EMBODIMENTS

Figure 1:
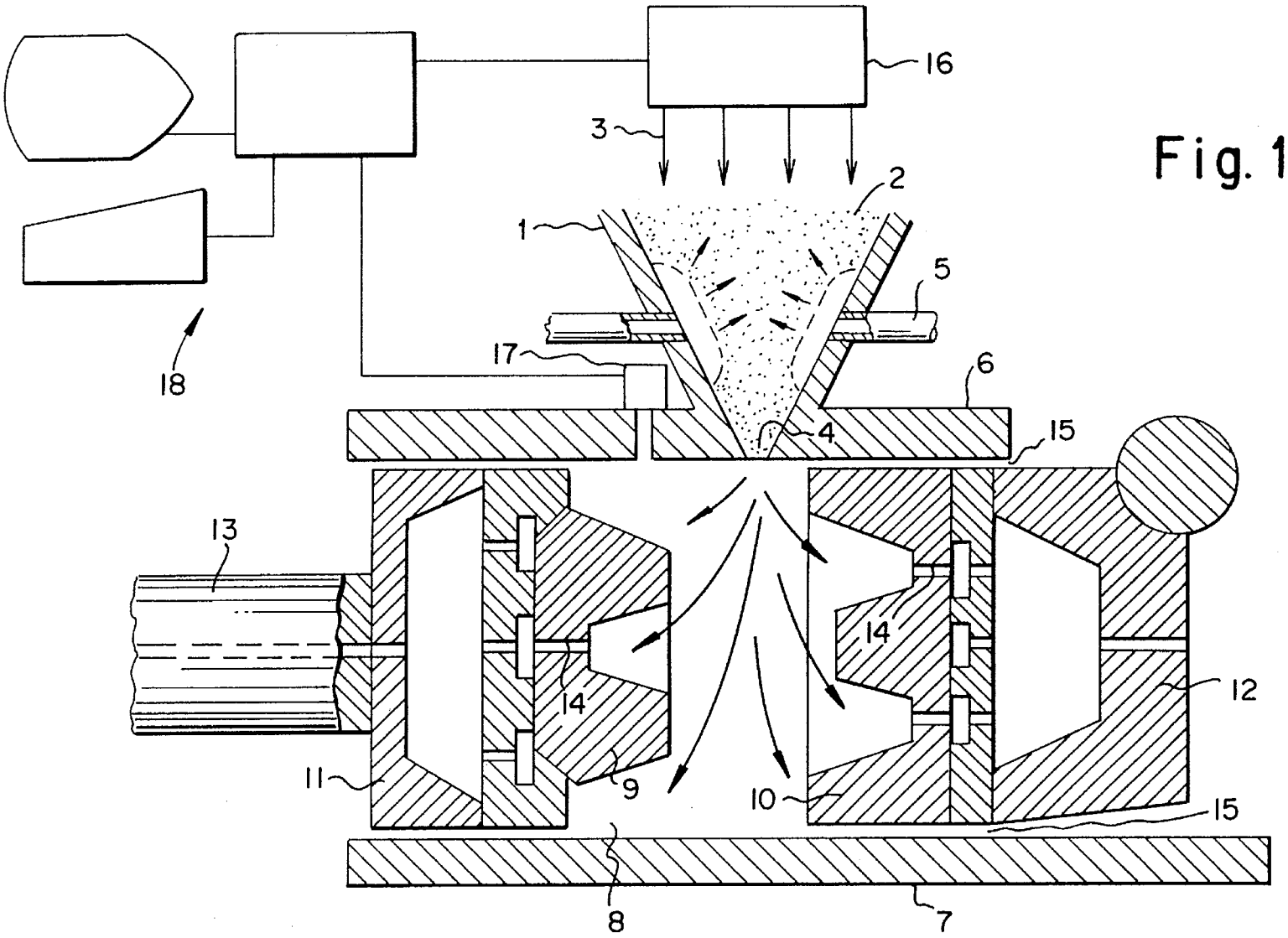
FIG. 1 shows an exemplary embodiment of an apparatus, shown partly in section, partly diagrammatically.

In the apparatus shown in FIG. 1, a sand supply chamber 1, of which solely the lowermost part is shown, is adapted to receive sand from a sand supply reservoir (not shown), and temporarily to store this mould sand 2. During the moulding process proper, air under pressure is supplied to the closed space above the sand 2 as indicated by arrows 3, so that the mould sand, being held in a fluidized state by air introduced through fluidizing ducts 5, can be forced downwardly through an outlet 4 into a mould chamber 8. The air is supplied by means of symbolically shown blowing-in means 16, adapted to be controlled by control equipment 18 in dependence on signals from a pressure sensor 17 sensing the pressure in the mould chamber 8, in a manner to be described below.

The mould chamber 8, which as shown is situated below the sand supply chamber 1, is limited upwardly and downwardly by a top plate 6 and a bottom plate 7 respectively, and sideways by two pattern plates 9 and 10 as well as two side plates covering the sides of the mould chamber 8 facing towards and away from the viewer and for this reason not being visible in FIG. 1. The pattern plates 9 and 10 are carried by squeeze plates 11 and 12 respectively. A piston device, of which solely a piston rod 13 is shown, is adapted to move the two squeeze plates 11 and 12 and hence the two pattern plates 9 and 10 towards each other with great force.

When the pattern plates 9 and 10 are moved towards each other, the sand having been introduced in the space between them is compacted so as to form a mould or mould part (not shown), in the present example being adapted to constitute one of a number of individual mould parts to be placed close to each other so as to form a so-called mould string (not shown), such as described e.g. in the International Patent Application No. PCT/DK90/00079.

During the compacting operation (not shown), the air contained in the sand must necessarily escape from the mould chamber 8, and means to this end being visible in FIG. 1 comprise a number of air ducts 14 formed in the pattern plates 9 and 10, as well as gaps 15 between on the one hand the top and bottom plates 6 and 7 and on the other hand the pattern plates 9 and 10 and the squeeze plates 11 and 12. Further air ducts may be formed in the side walls (not shown) of the mould chamber 8 situated in front of and behind the plane of the drawing, as well as possibly in the top wall of the mould chamber.

The process of introducing the sand into the mould chamber 8, in the following designated the "sand-shooting process", will now be described in more detail, in the first instance with reference to FIGS. 2 and 3.

Figure 2:
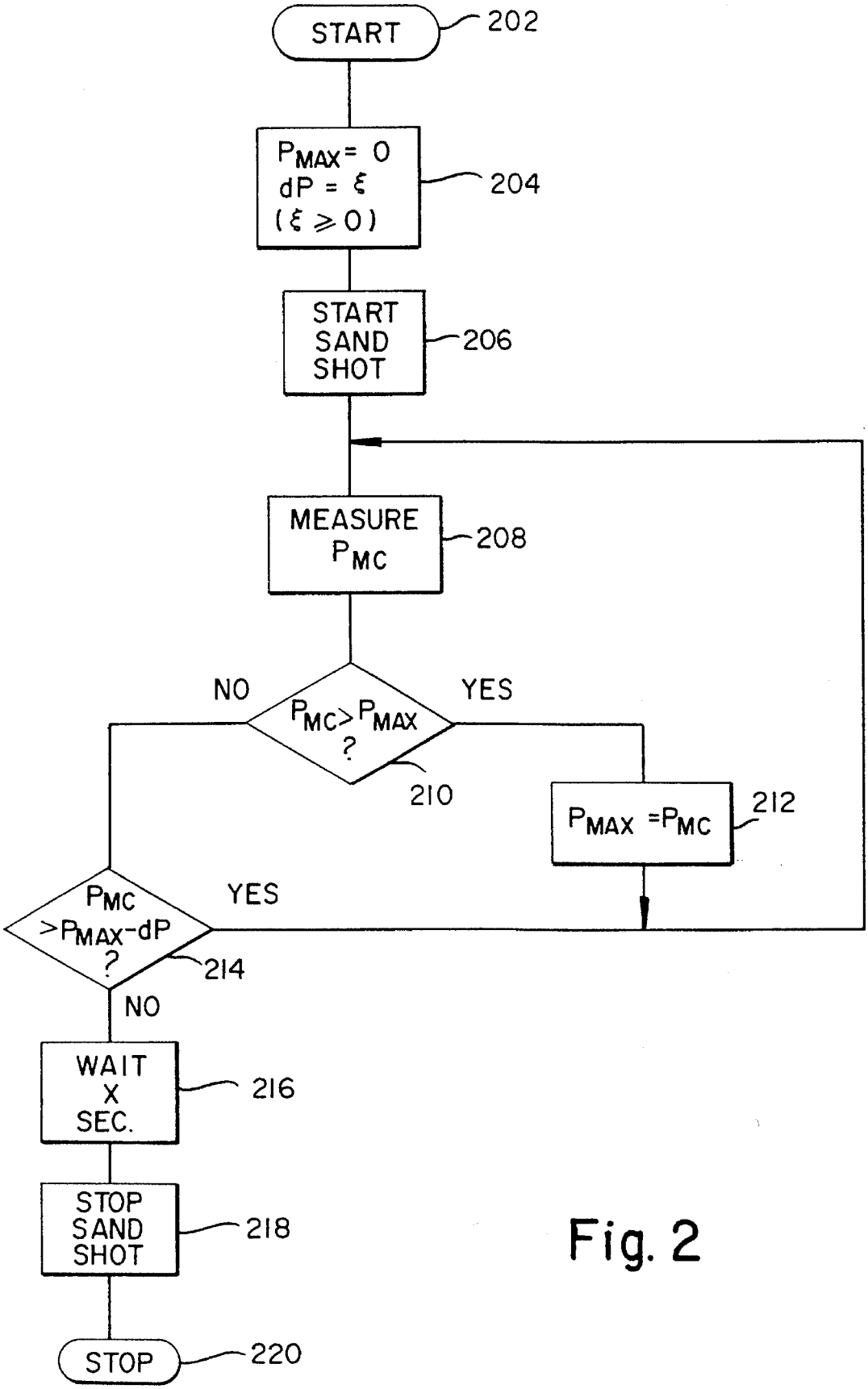
FIG. 2 shows a process diagram that may be used as a basis for programming the control equipment in the apparatus shown in FIG. 1.
Figure 3:
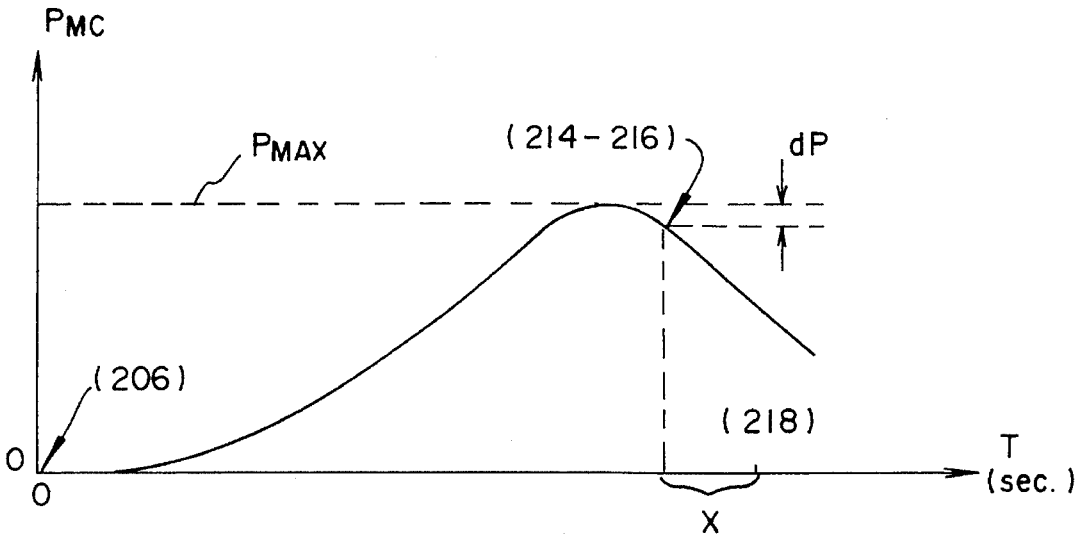
FIG. 3 is a graph showing the mould-chamber pressure as a function of time when using the process diagram shown in FIG. 2 as a basis for programming.

In fact, FIGS. 2 and 3 speak for themselves, for which reason it should be sufficient to state briefly, that when the mould-chamber pressure $P_{MC}$ after having passed through a maximum and then taken on a value less by dP, the sand shooting is stopped, unless one has chosen to wait for a short interval of x seconds. Thus, the primary criterion for stopping the sand shooting is that the mould-chamber pressure $P_{MC}$ has passed through a maximum.

Figure 5:
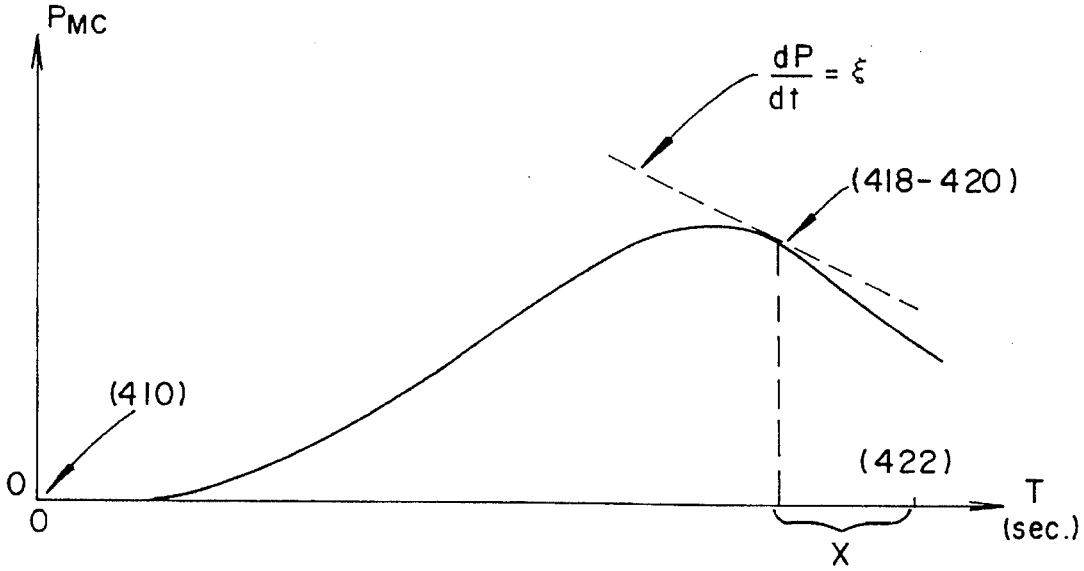
FIG. 5 shows a graph showing the mould-chamber pressure as a function of time when the process diagram shown in FIG. 4 is used as a basis for programming.
Figure 4:
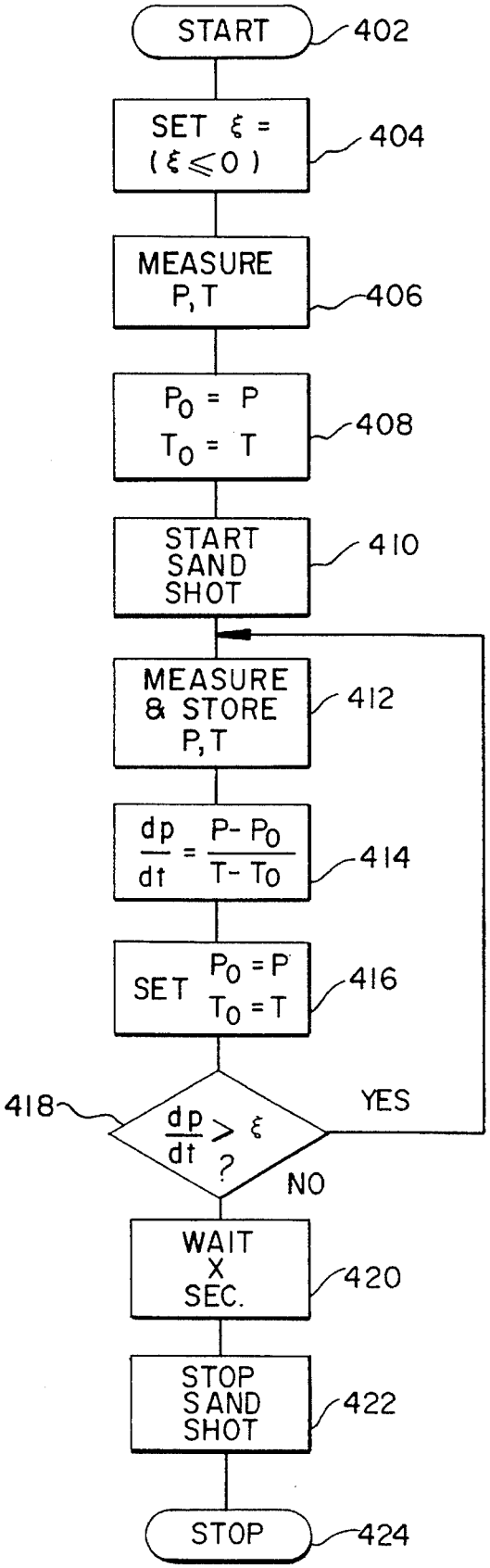
FIG. 4 shows an other example of a process diagram that may be used as a basis for programming the control equipment in the apparatus shown in FIG. 1.

Even FIGS. 4 and 5 may be said to speak for themselves; the processes described in these figures differ from the processes according to FIGS. 2 and 3 in that the primary criterion for terminating the sand shooting is that the derivative of the mould-chamber pressure with respect to time, dP/dt, takes on a predetermined negative value $\epsilon$—such a negative value can, of course, only appear after the mould-chamber pressure $P_{MC}$ having passed through a maximum.

In this case also, it is possible to choose to postpone the termination of the sand shooting by a short interval of x seconds.

It is not unthinkable that the mould-chamber pressure under certain circumstances may rise intermittently or stepwise in such a manner, that it runs through at least one maximum before increasing up to the maximum shown by experience to correspond to the mould chamber having been filled. If so, control equipment having been programmed on the basis of the process diagram shown in FIG. 2 or FIG. 4, would, of course, terminate the sand shooting prematurely. This can be avoided by inserting loops in the programmes concerned, said loops monitoring the time having passed and/or the mould-chamber pressure and preventing termination of the sand shooting, if one or more maximums should appear before a predetermined time interval has passed and/or a predetermined mould-chamber pressure only slightly less than the expected maximum pressure should be achieved. Such loops are not shown in the drawing, but persons with an elementary knowledge of programming will easily be able to establish such loops so as to ensure that the sand shooting is not terminated prematurely.

FIG. 1 shows only one single pressure sensor 17, but it will obviously lie within the scope of the invention to use a number of sensors placed at "strategic" points in the mould-chamber walls and to adapt the control equipment 18 to process the signals from these sensors with a view to an optimum filling of the mould chamber 8.

I claim:

1. A method of manufacturing moulds within a mould chamber comprising the steps of:

continuously blowing particulate material into a mould chamber wherein said blowing of the particulate material into the mould chamber creates a pressure within the mould chamber which increases to a first maximum pressure and then decreases:

monitoring said pressure within the mould chamber; and terminating said blowing of the particulate material after said pressure within the mould chamber reaches said first maximum pressure.

2. A method according to claim 1 and further including the step of continuing said blowing of the particulate material into the mould chamber if said first maximum pressure is reached before a predetermined period of time after commencing said blowing; and terminating said blowing after said pressure within the mould chamber reaches a second maximum pressure, subsequent to reaching said first maximum pressure.

3. A method according to claim 1 wherein said blowing is terminated at a predetermined interval of time after reaching said first maximum pressure.

4. A method according to claim 1 wherein said blowing is terminated when, after reaching said first maximum pressure, the pressure in the mould chamber has decreased a predetermined amount below said maximum pressure.

5. A method according to claim 4 wherein said predetermined amount is a portion of said maximum pressure.

6. An apparatus for manufacturing moulds comprising;

means defining a mould chamber;

blowing-in means for continuously blowing particulate material into said mould chamber wherein said blowing creates a pressure within the mould chamber which increases to a first maximum pressure and then decreases;

pressure sensing means for sensing said pressure in said mould chamber; and control means for operatively controlling said blowing-in means, said control means operatively connected to said pressure sensing means wherein said control means terminates said blowing after said pressure sensing means senses that said pressure in the mould chamber has reached said first maximum pressure.

7. Apparatus according to claim 6 wherein, if said pressure in said mould chamber reaches said first maximum pressure prior to a predetermined time interval after commencement of said blowing, said control means terminates said blowing after a second maximum pressure is reached.

8. Apparatus according to claim 6 wherein said control means terminates said blowing when said pressure in said mould chamber has decreased a predetermined amount below said maximum pressure.

9. Apparatus according to claim 8 wherein said predetermined amount is a portion of said maximum pressure.

* * * * *